US007648276B2

(12) United States Patent
Gill

(10) Patent No.: US 7,648,276 B2
(45) Date of Patent: Jan. 19, 2010

(54) SEALING DEVICE FOR FLEXIBLE LIQUOR CONTAINER

(75) Inventor: Yoram Gill, Haifa (IL)

(73) Assignee: Source Vagabond Systems Ltd., Tirat Carmel (IL)

( * ) Notice: Subject to any disclaimer, the term of this patent is extended or adjusted under 35 U.S.C. 154(b) by 719 days.

(21) Appl. No.: 09/989,334

(22) Filed: Nov. 20, 2001

(65) Prior Publication Data

US 2002/0094140 A1 Jul. 18, 2002

(30) Foreign Application Priority Data

Nov. 21, 2000 (IL) ..... 139801
Aug. 8, 2001 (IL) ..... 144800

(51) Int. Cl.
*B65D 33/16* (2006.01)

(52) U.S. Cl. ..... 383/68; 383/66; 383/908

(58) Field of Classification Search ..... 383/89, 383/25, 30, 31, 68, 90, 85, 88, 66, 904; 24/460, 24/461, 30.5 R, 30.5 L, 570; D9/435; 224/148.2
See application file for complete search history.

(56) References Cited

U.S. PATENT DOCUMENTS 468,257 A * 2/1892 Paige ..... 383/13
1,246,530 A * 11/1917 Bird ..... 383/30
1,361,605 A * 12/1920 Morrill ..... 383/69
2,601,568 A * 6/1952 Sussenbach et al. ..... 383/69
3,141,221 A * 7/1964 Faulls, Jr. ..... 24/30.5 R
3,266,711 A * 8/1966 Song ..... 383/13
3,481,007 A * 12/1969 Scarritt, Jr. ..... 24/30.5 L
3,939,533 A * 2/1976 Benepe ..... 24/30.5 R
4,009,287 A * 2/1977 Clarke ..... 426/106
4,040,562 A * 8/1977 Ward et al. ..... 383/30
4,871,264 A * 10/1989 Robbins et al. ..... 383/68
D331,364 S * 12/1992 Barker et al. ..... D9/434
D372,674 S * 8/1996 Weber et al. ..... D9/443
5,613,282 A * 3/1997 Deddens et al. ..... 24/30.5 R
5,816,457 A 10/1998 Croft
5,913,456 A 6/1999 Dikeman
5,941,640 A 8/1999 Thatcher
5,983,460 A * 11/1999 Hyde et al. ..... 24/30.5 R
6,132,089 A * 10/2000 Galomb et al. ..... 383/63
6,231,235 B1 * 5/2001 Galomb et al. ..... 383/63
6,247,619 B1 6/2001 Gill et al.

FOREIGN PATENT DOCUMENTS

FR 74516 * 12/1960 ..... 383/68
GB 2266701 * 11/1993 ..... 383/68
IT 544362 * 1/1958 ..... 383/25
IT 597773 * 9/1959 ..... 383/68
WO WO 92/16424 A1 * 10/1992

* cited by examiner

*Primary Examiner*—Robin Hylton
(74) *Attorney, Agent, or Firm*—Pearl Cohen Zedek Latzer, LLP

(57) ABSTRACT

Sealing device for flexible liquid container is disclosed. In one preferred embodiment of the invention, the sealing device comprises an elongated member with a hollow passage extending through it with a longitudinal slot, slidingly mountable over a rod, which is provided over a lateral opening of a flexible liquid container. In another preferred embodiment of the present invention the rod is attached to the member extending through the passage. When the portion of the container provided with the lateral opening is folded over the rod, substantially overlapping an adjacent portion of the container and the sealer is slidingly mounted over the folded portion of the container, liquid is prevented from leaking out of the container through the lateral opening.

5 Claims, 5 Drawing Sheets

Figure 2
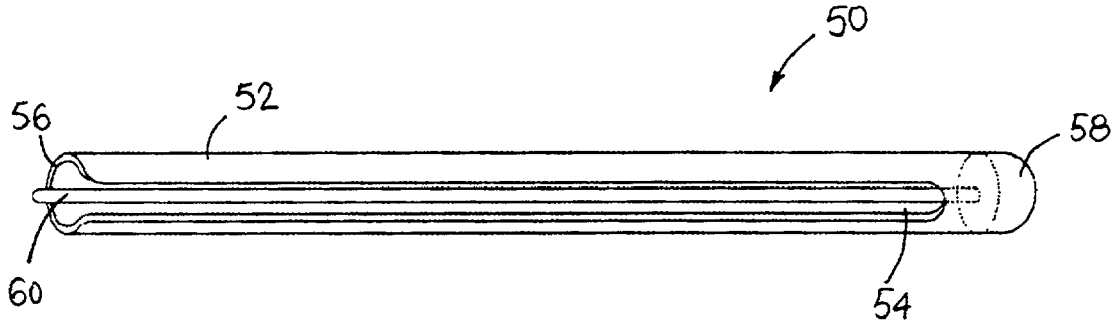
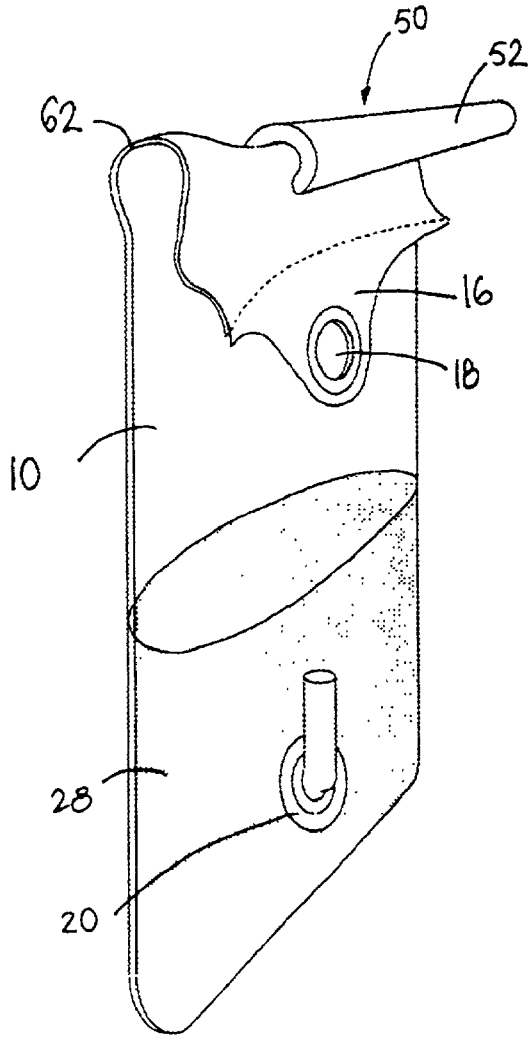
Figure 3A
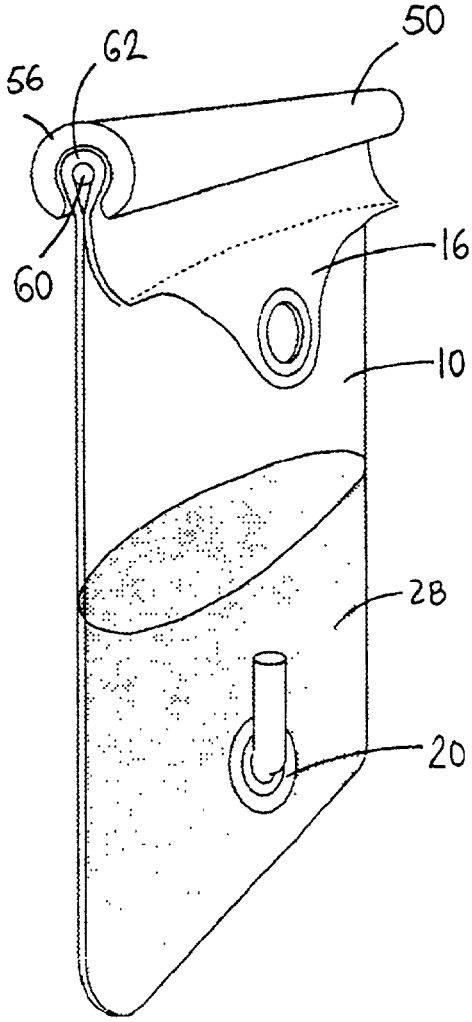
Figure 3B

SEALING DEVICE FOR FLEXIBLE LIQUOR CONTAINER

FILED OF THE INVENTION

The present invention relates to liquid containers. More particularly, the present invention relates to a liquid container provided with a sealer that is adapted to close a wide opening in the container.

BACKGROUND OF THE INVENTION

Personal hydration systems are known in the art and are used extensively by people that are active in sports, trekking activities, recreational is activities as well as in the military. Over the last decade, people in general and especially people that are active in physical activities became aware of the fact that drinking during physical activity is crucial from health considerations. Therefore, personal hydration systems were developed over the years and since the use of soft polymers such as polyurethane became applicable in designing the drinking containers of the hydration systems, flexible containers, bladder-like containers, became widely used. An example for a personal hydration system is shown in U.S. Pat. No. 5,816,457 "hydration system" by Croft, filed in 1996. This patented hydration system for backpackers or other athletes includes a bladder, a filling opening, an enclosing cover and filling opening, a flexible line and a deformable valve to be held in the user's mouth. Another hydration system was invented by the inventor of the present invention (Gill Yoram) and Ezer Asaf and disclosed in PCT patent application no. PCT/IL97/00263 (filed in the U.S. Ser. No. 09/297,384) "Flexible Container for Storing and Dispensing Liquids". This flexible container comprises an inner bag and at least one outer bag, and liquid dispensing means.

One of the problems stemming from the use of flexible polymers in the design of hydration containers is that they are not easily cleaned. The soft polymer itself is a material that may absorb matter from the liquid, especially if the liquid filled in the container is juice or tea or other sugar containing liquid. In addition, the container is soft and has welded areas, therefore residues of the liquid that was inside the container may be left in corners formed in the sides of the container. Cleaning becomes a problem even when using the opening of the container from which the container is filled by liquid since this opening is usually relatively small. Accessories for cleaning flexible containers are available (can be purchased in the markets) but still, the maintenance of the container is difficult.

Most of the flexible containers are made from two flexible sheets of polymer welded together from all sides while an opening for filling the container and drinking from it is formed on the side of the container in the surface of one of the sheets. One of the solutions for the maintenance problem in those types of flexible containers is to leave a large opening on one of the sides of the container by leaving an unwelded area. It is straightforward that the unwelded area that acts as an opening is in the narrower side of the container while it becomes very easy to clean the interior of the container by inserting a hand into it. Moreover, it is easy to dry the container after cleaning is finished and there is no need for expensive cleaning and drying accessories.

Leaving an unwelded area to be used as an opening for cleaning the container brought about another problem. The ability to hermetically seal this opening when the container is in use and filled with liquid is diminished. Several solutions are available on the markets. Two of the solutions ("easy clean" from Blackburn company and another container from ultimate direction company) are based on an extended opening that may be folded several times and possibly to different directions. The folds of "easy clean" may be secured by hook and loop fastenrs. The solution of ultimate direction is based on U.S. Pat. No. 5,941,640 "Roll Top Bladder" by Thatcher filed in 1997. This bladder includes two sidewall portions, which are disposed opposite one another and joined along a majority of the perimeter. In the unattached portion, a neck is formed, which extends from the body of the bladder. To close the conduit formed by the neck portion, the neck portion is rolled towards the body. The rolled neck portion seals the opening closed and prevents liquid from escaping out of the neck. Another solution is offered by cascade designs company. Here, their platypus flexible hydration system is closed by a "big zip". The closure is based on the idea of a plastic zipper in which one side of the opening is provided with a strip that protrudes from the sheet surface and opposite to the strip, a corresponding groove is provided. When the user wishes to close the container, he presses the strip into the groove so that the opening is closed. Another solution that is based on the idea of a ZIP-LOCK® is disclosed in U.S. Pat. No. 5,913,456 by Dileman "Pressurized Portable Drinking System" filed in 1997. This patent discloses a liquid dispenser that includes a container formed of a flexible synthetic resin material and a hose connected to the container for dispensing liquid. Among other features, the dispenser also includes a closure assembly that is positionable in a scaled position sealing a cavity shut beneath a mouth so that the cavity is substantially liquid tight, and an unscasled position exposing the cavity to the mouth for filling.

In all the available solutions including the above mentioned ones, the container is prone to liquid leakage. In all of these cases, the container has to be positioned so that the opening is in the upper side of the container at all times. This fact prevents the free use of the container to many of the application that these containers are designed for. For example, when the personal hydration system is placed on the rear of a bike, it is most convenient to put the container on its side. Placing a container having a cleaning opening closed in the way described herein above cause leakage and loses of liquid. Those containers may be used only when the container is hanged, a fact that limits the use of the personal hydration system. There is a need to provide an easy way to close the hydration container so that the container is completely sealed when in use. Moreover, when the container is safely sealed, it may be placed in any orientation without leakage. Another problem that originates from using a zip-like closure is that when the container is filled, the user has to squeeze the side edges of the container in order to open up the opening. This operation is uncomfortable.

SUMMARY OF THE INVENTION

It is an object of the present invention to provide a flexible personal hydration container provided with a sealer that hermetically closes a wide opening in the container.

It is yet another object of the present invention to provide a flexible personal container provided with a sealer that safely secures and closes an opening in the container so that liquid from the container would not leak even when the container is full and even if the container is positioned with the opening in its bottom.

Yet, it is another object of the present invention to provide a flexible personal container provided with a sealer that closes a relatively wide opening that is large enough so that the opening may be used in order to fill liquid into the container and clean the container.

It is a further object of the present invention to provide a container provided with a sealer that is durable in extensive out-door activity.

Further, it is another object of the present invention to provide a flexible hydration container provided with a sealer that is cheap and easy to use.

It is thus provided a sealing device adapted to seal a flexible liquid container having a cavity for receiving liquids, a lateral opening for filling the container with liquids, and a liquid dispensing outlet, said sealing device comprising:

a hollow cylinder having an open end and a closed end, said cylinder is provided with an elongated slot extended from the closed end to the open end, wherein said slot meets said open end;

a rod attached to said close end, positioned inside and substantially concentric to said hollow cylinder;

whereby when a portion of the container provided with the lateral opening is folded while substantially overlapping an adjacent portion of the container, and said hollow cylinder is slidingly mounted onto the folded portion of the container while said rod is threaded in the fold between the adjacent portions, liquid is prevented from leaking out of the container through the lateral opening.

Furthermore, in accordance with another preferred embodiment of the present invention, the length of said sealing device is at least as the length of the lateral opening.

Furthermore, in accordance with another preferred embodiment of the present invention, a cap closes said closed end.

Furthermore, in accordance with another preferred embodiment of the present invention, said rod is slightly protruding beyond said open end.

Furthermore, in accordance with another preferred embodiment of the present invention, said flexible container is formed from two films having the majority of their perimeter fused, allowing a portion of the perimeter unfused so as to acts as the opening.

Furthermore, in accordance with another preferred embodiment of the present invention, said slot is slightly wider than twice the cumulative thickness of said two films.

Furthermore, in accordance with another preferred embodiment of the present invention, the distance between the outer diameter of said rod and the inner diameter of said hollow cylinder is slightly larger than the cumulative thickness of said two films so that said two films may be freely threaded between said rod and said hollow cylinder and so that said two films are tightly contiguous.

Furthermore, in accordance with another preferred embodiment of the present invention, one of said two films has an extension that goes beyond the lateral opening.

Furthermore, in accordance with another preferred embodiment of the present invention, said extension is provided with a hole.

Furthermore, in accordance with another preferred embodiment of the present invention, said flexible container is made of a material selected from a group of materials such as polyethylene, PVC or polyurethane.

Furthermore, in accordance with another preferred embodiment of the present invention, said rod has a round cross section.

Furthermore, in accordance with another preferred embodiment of the present invention, said sealing device is made from a rigid polymer, said rigid polymer is selected from a group of materials such as ABS or acethal polypropylene.

Furthermore, in accordance with another preferred embodiment of the present invention, it is provided a sealing device adapted to seal a flexible liquid container having a cavity for receiving liquids, a lateral opening for filling the container with liquids, and a liquid dispensing outlet, said sealing device comprising:

a rod having a first end and a second end, provided laterally across the flexible container so that a portion of the container adjacent the lateral opening can be folded over the rod and substantially overlap an adjacent portion of the container; and a sealer comprising an elongated member having two opposite sides along which a hollow passage is extended with a longitudinal slot, wherein the sealer is provided with an opening on at least one of the opposite sides, and wherein said sealer is slidingly mountable over said rod, wherein the space defined within the passage is not smaller than the total space occupied by the portion of the container provided with the lateral opening folded over the rod and the rod itself when inserted in the passage, and wherein the slot is not narrower than the total thickness of the folded portion of the container and the adjacent portion when inserted through the slot, whereby when the portion of the container provided with the lateral opening is folded over the rod, substantially overlapping an adjacent portion of the container and the sealer is slidingly mounted over the folded portion of the container and the rod, liquid is prevented from leaking out of the container through the lateral opening.

Furthermore, in accordance with another preferred embodiment of the present invention, the length of said rod is slightly longer than a length defining the lateral opening of the container.

Furthermore, in accordance with another preferred embodiment of the present invention, the first end of the rod is provided with a resilient lateral protrusion and the second end of the rod is provided with a stopper having a diameter that is larger than a diameter of the passage of said sealer.

Furthermore, in accordance with another preferred embodiment of the present invention, said rod is welded to the flexible container.

Furthermore, in accordance with another preferred embodiment of the present invention, the flexible container is formed from two adjacent films of polymeric material having a majority of their perimeter welded, and wherein the lateral opening is a portion of the perimeter, which is not welded.

Furthermore, in accordance with another preferred embodiment of the present invention, said passage has a horse-shoe-like cross section, and wherein the cross-section is substantially constant along said elongated member.

Furthermore, in accordance with another preferred embodiment of the present invention, said rod has substantially elliptic cross section.

Furthermore, in accordance with another preferred embodiment of the present invention, said sealer is made from a rigid polymer, said rigid polymer selected from ABS and acetal polypropylene.

Furthermore, in accordance with yet another preferred embodiment f the present invention, it is provided a sealable flexible liquid container comprising:

a flexible liquid container having a cavity for receiving liquids, a lateral opening for filling the container with liquids and for cleaning the container, and a liquid dispensing outlet;

a rod having a first end and a second end, said rod is slightly longer than a length defining the lateral opening; and a sealer comprising an elongated member having two opposite sides along which a hollow passage is extended with a longitudinal slot, wherein the sealer is provided with an opening on at least one of the opposite sides, and wherein said sealer is slidingly mountable over said rod, wherein the space defined within the passage is not smaller than the total space occupied by a portion of the container provided with the lateral opening folded over the rod and substantially overlap an adjacent portion of the container, and the rod itself when inserted in the passage, and wherein the slot is not narrower than the total thickness of the folded portion of the container and the adjacent portion when inserted through the slot, whereby when the portion of the container provided with the lateral opening is folded over the rod, substantially overlapping an adjacent portion of the container and the sealer is slidingly mounted over the folded portion of the container and the rod, liquid is prevented from leaking out of the container through the lateral opening.

Furthermore, in accordance with another preferred embodiment of the present invention, said rod is provided laterally across the flexible container.

Furthermore, in accordance with another preferred embodiment of the present invention, said rod is welded to the flexible container.

Furthermore, in accordance with another preferred embodiment of the present invention, the first end of the rod is provided with a resilient lateral protrusion and the second end of the rod is provided with a stopper having a diameter that is larger than a diameter of the passage of said sealer.

Furthermore, in accordance with another preferred embodiment of the present invention, said rod is provided inside and substantially concentric to said elongated member and is attached to a side of the opposite sides of said elongated member that is closed.

Furthermore, in accordance with another preferred embodiment of the present invention, said rod is slightly protruding out from the opening that is opposite the closed side of said elongated member.

Furthermore, in accordance with another preferred embodiment of the present invention, the flexible container is formed from two adjacent films of polymeric material having a majority of their perimeter welded, and wherein the lateral opening is a portion of the perimeter that is not welded.

Furthermore, in accordance with another preferred embodiment of the present invention, said passage has a horse-shoe-like cross-section, and wherein the cross-section is substantially constant along said elongated member and wherein said rod has substantially elliptic cross section.

Furthermore, in accordance with another preferred embodiment of the present invention, said sealer is made from a rigid polymer, said rigid polymer selected from ABS and acetal polypropylene.

And furthermore, in accordance with another preferred embodiment of the present invention, said flexible container is made of a material selected from a group of materials such as polyethylene, PVC or polyurethane.

BRIEF DESCRIPTION OF THE FIGURES

FIG. 2 illustrates an isometric view of a sealer for personal hydration systems in accordance with a preferred embodiment of the present invention.

FIG. 3A illustrates the sealer shown in FIG. 2 and the personal hydration system shown in FIG. 1 during the closing course of the hydration system.

FIG. 3B illustrates the personal hydration system shown in FIG. 1, fully closed by the sealer for hydration system shown in FIG. 2.

DETAILED DESCRIPTION OF THE INVENTION AND THE FIGURES

The unique seal of the present invention is adapted to hermetically seal personal hydration containers having an opening that is relatively large so as to enable easy filling and easy cleaning of the container through the opening. The seal prevents leakage of liquid from the container, no matter what the orientation of the container is. Therefore, the container may be positioned in any orientation as well as on its side without leakage.

Figure 1:
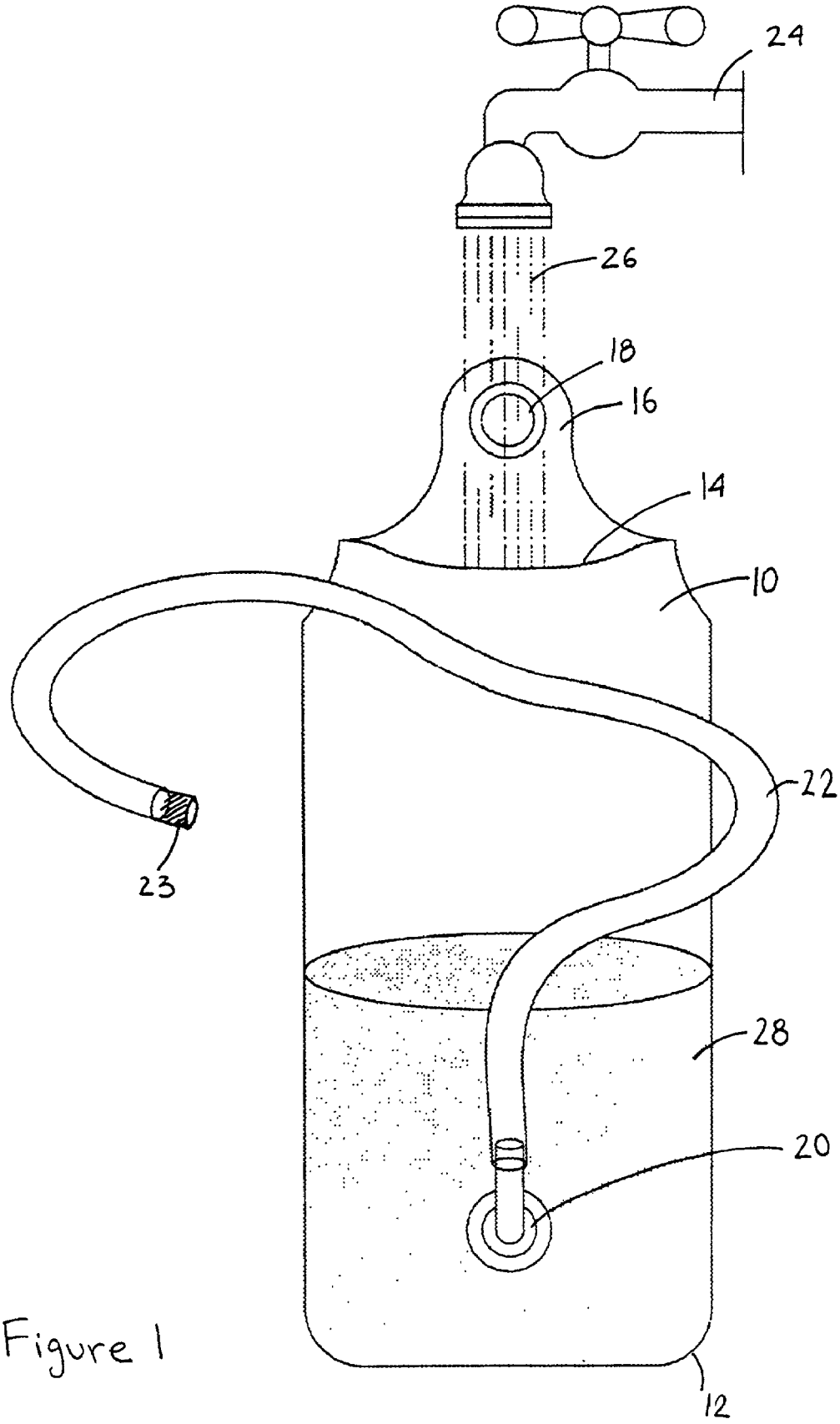
FIG. 1 illustrates a view of a personal hydration system being filled with water through an opening in accordance with a preferred embodiment of the present invention.

Reference is now made to FIG. 1 illustrating a view of a personal hydration system being filled with water through an opening in accordance with a preferred embodiment of the present invention. The container 10 is a flexible and flat container that is made from a polymeric material such as polyurethane, PVC, or polyethylene. Container 10 is made from two films of polymeric material that are welded together at three sides 12 of the container, near its perimeter. The fusion is performed by conventional methods such as ultrasonic high frequency or heat. The welded sides of the films form a cavity that is adapted to receive liquid. At one of the narrower sides of container 10, the perimeter is not welded so that an opening 14 is formed. One of the polymeric films has an extension 16 that facilitates in the opening of opening 14 when the container is filled since the two films forming the container are adjacent to each other. Extension 16 provides also a griping portion for handling the container. A hole 18 is provided in extension 16. Hole 18 may be used in order to suspend container 10 when it is stored or when the container is being cleaned or dried.

Container 10 is provided with a liquid dispensing opening 20 in one side, close to the bottom of the container. Liquid dispensing opening 20 is designated to be connected to a flexible drinking pipe 22. At the proximal side of drinking pipe 22, a drinking valve 23 is provided. In order to fill container 10 with liquid such as water, opening 14 is oriented at the top of the container and freely opened. Container 10 is suspended with opening 14 wide open so that water 26 coming out from water tap 24 is directed to fill container 10. Water 28 that is filled in container 10 may be drunk from container 10 through flexible drinking pipe 22 and drinking valve 23.

Opening 14 is a large opening relative to the openings that are usually available in such containers so that the container may be filled conveniently (as shown in FIG. 1). Moreover, ice cubes or any other solids or herbs may be inserted also very easily through opening 14. But, when the container is to be cleaned, the advantages of opening 14 are the most significant. A hand with a cleaning cloth may be easily inserted into the container so that there is no need in special cleaning accessories. Moreover, the opening does not have any folds or welded cup's screw so that leftovers from the liquid can not be trapped in the folds and the cleaning is optimal.

After water fills container 10 and it is ready to be used, opening 14 has to be hermetically closed. Reference is now made to FIG. 2, illustrating an isometric view of a sealer for personal hydration systems in accordance with a preferred embodiment of the present invention. Sealer 50 comprises a hollow cylinder 52. Cylinder 52 has two ends, the first end is an open end 56 and the second end is closed, preferably by a cap 58. An elongated slot 54 is carved along the side of cylinder 52, slot 54 meets open end 56. In the zone where the slot meets the open end of the cylinder, a broadening of the slot is provided so that the threading of the container into the slot is easier. A concentric and elongated rod 60 is attached substantially at the center of cap 58 and protrudes slightly through open end 56. Sealer 50 is preferably made from a rigid polymeric material such as acethal polypropylene or ABS.

Reference is now made to FIG. 3A illustrating the sealer shown in FIG. 2 and the personal hydration system shown in FIG. 1 during the closing course of the hydration system. Container 10 is folded in a way that extension 16 is wrapped over opening 14 and a fold 62 is formed. Opening 14 is fully on one side of the fold while the liquid receiving cavity is fully on the other side of the fold. Fold 62 is threaded into cylinder 52 of sealer 50 so that fold 60 is between the cylinder and rod 60. In order to establish this position, open end 56 of sealer 50 is positioned so that it wraps one side of fold 62, the rod is positioned in the interior of the fold and sealer 50 slidably proceeded towards the other side of the fold. The reason rod 60 protrudes from hollow cylinder 52 is to ease the insertion of the fold between the rod and the cylinder. The extended rod acts as a guide when the fold is threaded inside the cylinder and makes the insertion of the cylinder and the rod onto the fold of the container easier. Sealer 50 can not be removed from the fold unless it slides in an opposite direction to the direction it has been put on since slot 54 is narrower than the diameter of rod 60. FIG. 3A shows sealer 50 half way put onto fold 62.

Reference is now made to FIG. 3B illustrating the personal hydration system shown in FIG. 1, fully closed by the sealer for hydration system shown in FIG. 2. Sealer 50 is fully slided onto fold 62 until cap 58 that acts also as a stopper collides into fold 62 and can not proceed. The length of sealer 50 is preferably the same or slightly longer than the length of container in the direction it is folded so that rod 60 slightly protrudes from cylinder 52 and the container's side. When sealer 50 is fully inserted and closes container 10, water 28 from the container can not leak even if the container is oriented up side down, so that the fold is in the bottom of the container.

The container is hermetically sealable if the slot in the hollow cylinder is slightly wider than twice the thickness of the container (the thickness of the container means the accumulative thickness of the two films that form the container). The thickness of the slot has to be optimized so that from one side it will be wide enough so that the folded container may be freely slided through the slot and from the other side, it has to be narrow enough so that water can not pass through the fold. In the same manner, the diameter of the elongated rod has to be adjusted so that the folded container may be freely inserted into the hollow cylinder between the cylinder and the rod. The two films in the fold that are situated between the hollow cylinder and the rod and inside the slot of the cylinder have to be tightly contiguous in order to establish a good sealing characteristic of the sealer. An example for optimized sizes of a container and a corresponding sealer are: for a container having thickness of approximately 0.9 mm (the thickness of the two films), a sealer having a slot of about 3 mm, a rod of about 3 mm in diameter and an inner cylinder diameter of about 11.5 mm will adapt to sealingly block the passage of liquid from the liquid receiving cavity through the fold while at the same time the insertion of the fold into the cylinder is easy.

Figure 4:
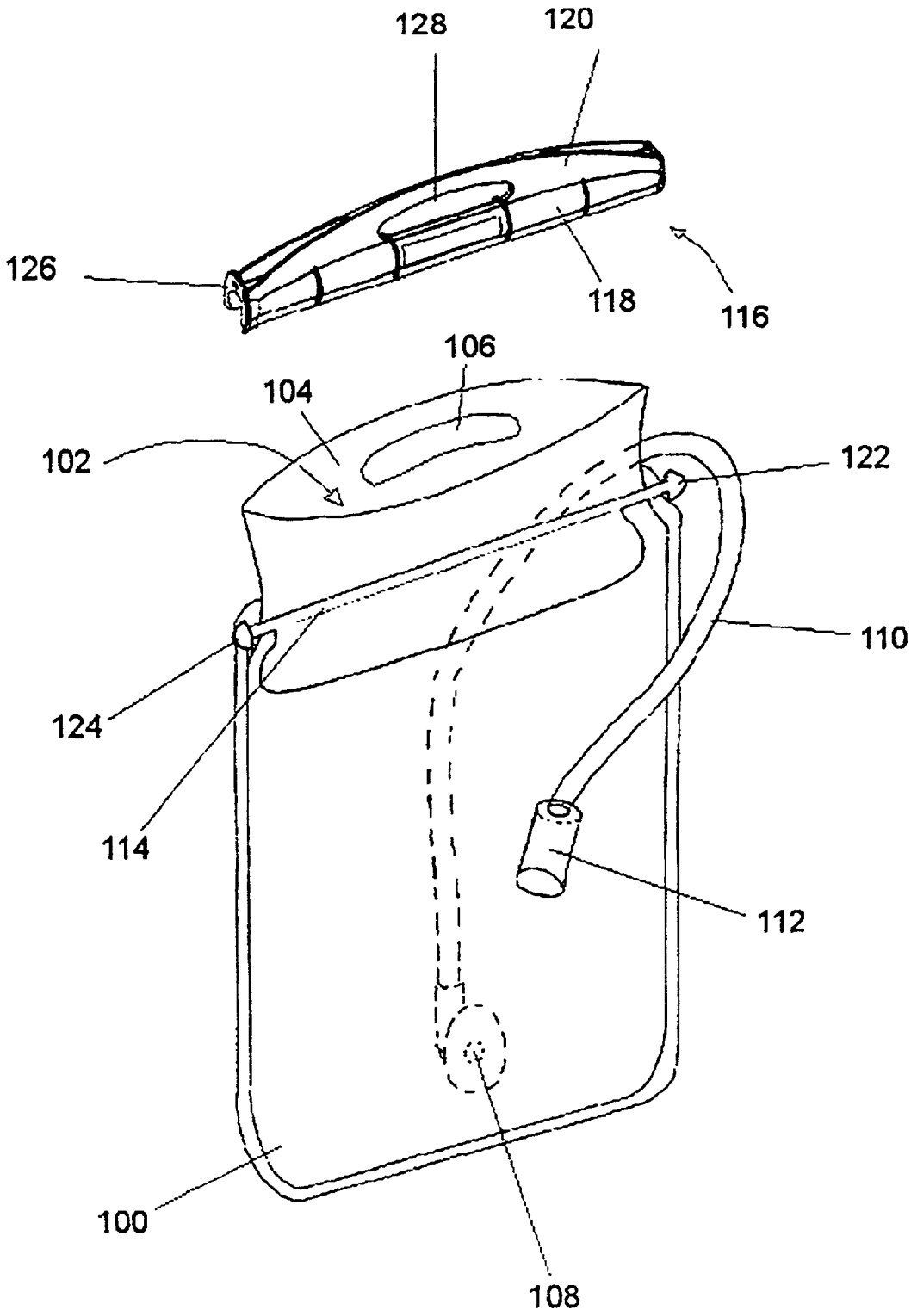
FIG. 4 illustrates an isometric view of a personal hydration system provided with a sealer in accordance with a preferred embodiment of the present invention, in an open state.

Reference is now made to FIG. 4 illustrating an isometric view of a personal hydration system provided with a sealer in accordance with a preferred embodiment of the present invention, in an open state. A flexible container 100 is a flat container that is made from a polymeric material such as polyurethane, PVC, or polyethylene. Container 100 is made from two films of polymeric material that are welded together at three sides of the container, near its perimeter. The fusion is performed by conventional methods such as ultrasonic high frequency or heat. The welded sides of the films form a cavity that is adapted to receive liquids. At one of the narrower sides of container 100, the perimeter is not welded so that an opening 102 is formed. Opening 102 is a large opening relative to the openings that are usually available in such containers so that the container may be filled conveniently and the user may clean the container by inserting his hand palm into the container. One of the polymeric films has an extension 104 that enables the user to handle the container while filling it or while cleaning it. Extension 104 provides also a griping portion for the container, therefore, a hole 106 is provided in extension 104. Hole 106 may be used in order to suspend container 100 when it is stored or when the container is being cleaned or dried.

Container 100 is provided with a liquid dispensing opening 108 in one side, close to the bottom of the container. Liquid dispensing opening 108 is connected to a flexible drinking pipe 110. At the proximal side of drinking pipe 110, a drinking valve 112 is provided.

Substantially parallel and close to opening 102, an elongated rod 114 is provided. Elongated rod 114 is preferably made of a relatively flexible yet rigid enough polymeric material that is laterally attached to container 100 and preferably welded to it. A separated sealer 116 is provided. Sealer 116 comprises an elongated member 118 having substantially horse-shoe-shaped cross-section and is adapted to internally accommodate rod 114. Rod 114 can be inserted or pulled out from the interior of elongated member 118 only by sliding the rod through the side openings of the internal cavity in elongated member 118. The rod's diameter is too large so as to be pulled out through the slot along the internal cavity of the elongated member. Sealer 116 further comprises a handle 120 that is design so as to enable the user to comfortably deal with the sealer. Handle 120 facilitates the user to hold the sealer and slide elongated member 118 onto rod 114. Sealer 116 is preferably made of a rigid polymeric material such as acetal polypropylene or ABS.

In order to seal container 100, extension 104 is wrapped over rod 114 and elongated member 118 is slidingly mounted over rod 114 and the wrap. As mentioned herein before, elongated member 118 is mounted over the rod by sliding the rod and wrap into the cavity of elongated member 118 from one of it sides. Rod 114 has two ends, the first end is provided with a lateral protrusion 122 and the second end is provided with a stopper 124. In order to slidingly mount elongated member 118 onto rod 114, lateral protrusion 122 is threaded into the interior of elongated member 118 through an opening 126 in the member. Elongated member 118 can be mounted on rod 114 only through the end provided with lateral protrusion 122. Lateral protrusion 122 may be inserted through opening 126 while stopper 124, on the other end of rod 114, can not be inserted through opening 126. In a preferred embodiment of the present invention the space defined within the passage in the sealer is not smaller than the total space occupied by the portion of the container provided with the lateral opening folded over the rod and the rod itself when inserted in the passage, and the slot is not narrower than the total thickness of the folded portion of the container and the adjacent portion when inserted through the slot.

Figure 5:
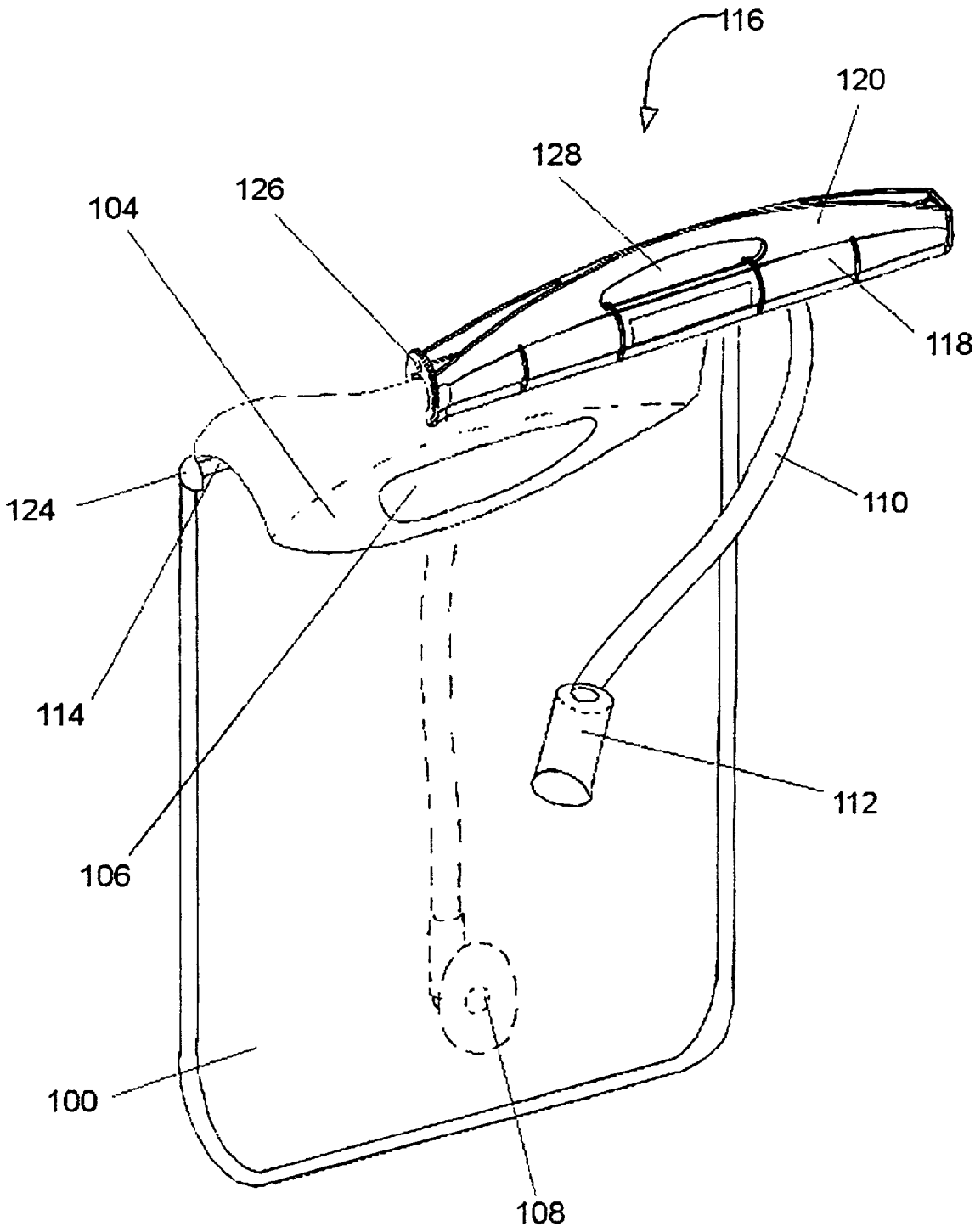
FIG. 5 illustrates an isometric view of the personal hydration system provided with a sealer shown in FIG. 1, partially closed.

Reference is now made to FIG. 5, illustrating an isometric view of the personal hydration system provided with a sealer shown in FIG. 4, partially closed. After extension 104 is folded over rod 114, opening 126 of elongated member 118 is mounted onto lateral protrusion 122 and elongated member 118 is slid onto rod 114. Opening 126 is provided with a broadening in the part where the fold passes through so that the threading of the rod and the fold through elongated member 118 is made easier.

Figure 6:
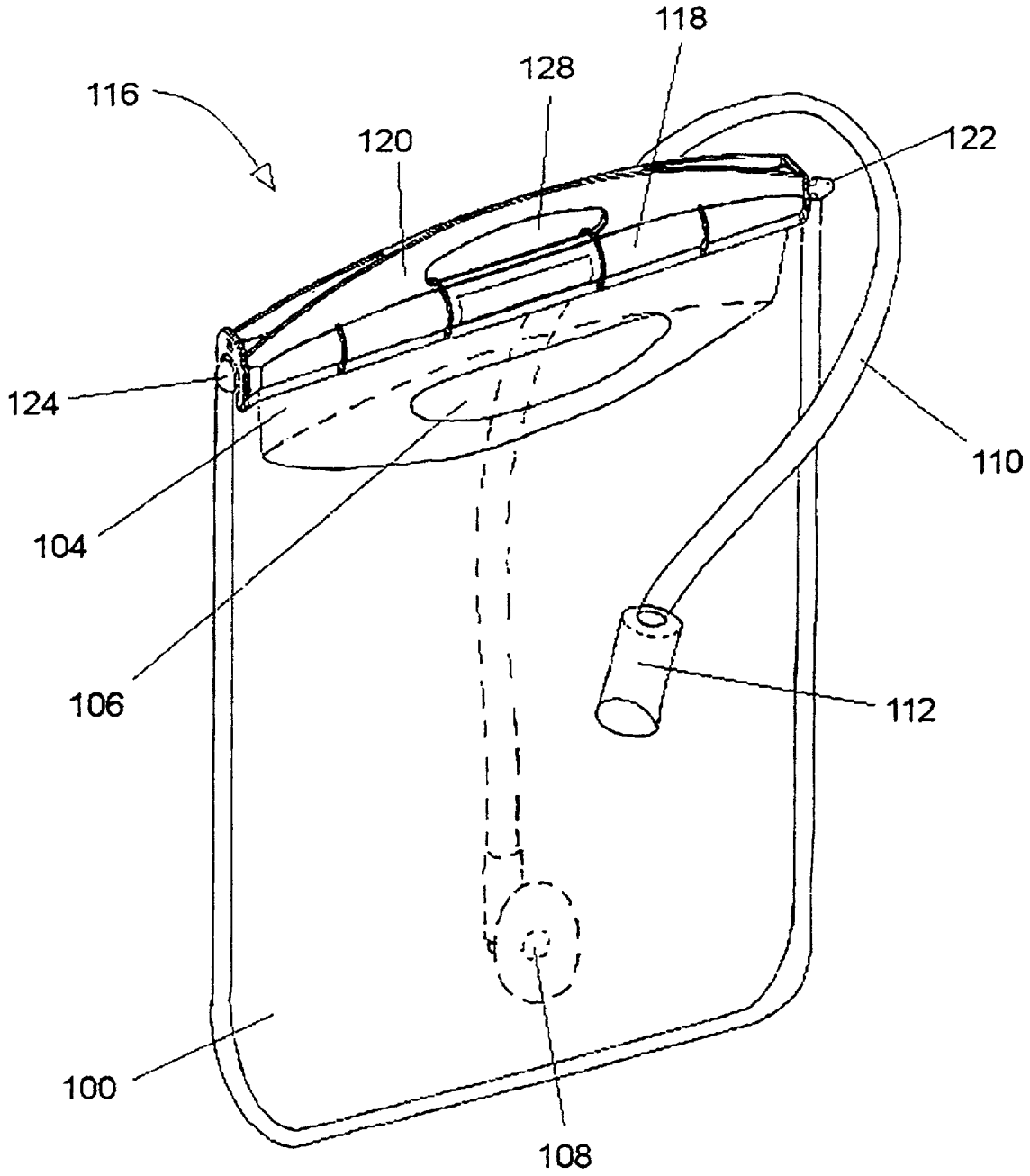
FIG. 6 illustrates an isometric view of the personal hydration system provided with a sealer shown in FIG. 4, fully sealed.

Reference is now made to FIG. 6 illustrating an isometric view of the personal hydration system provided with a sealer shown in FIG. 4, fully sealed. Sealer 116 is fully sliding onto rod 114 (can not be seen in FIG. 6, fully inserted in elongated member 118). Stopper 124 stops sealer 116 from proceeding outwardly from rod 114. In the fully sealed state, sealer 116 is restrained in the position shown in the figure since from one side, stopper 124 restrain it and from the other side, lateral protrusion 122 prevents sealer 116 from sliding back through it. When Container 100 is to be opened, lateral protrusion 122 has to be laterally pushed in order to enable the protrusion to pass through opening 126. Therefore, the length of sealer 116 is slightly less than the length of rod 114 but it is designated so that end 126 is adjacent to stopper 124 while the second opening of elongated member 118 is adjacent to lateral protrusion 122. In this way, the sealer completely seals the container.

It is preferable to design elongated rod 114 so that its cross section will be elliptic rather than circular and will be positioned with the ellipse elongated diameter parallel to the plane of the polymeric film. In this way, the rod is positioned in the interior of elongated member 118 so as to establish a complete and hermetic closure of container 100.

Handle 120 is provided with a hole 128. When sealer 116 seals container 100, hole 128 may be used in order to suspend the container.

The container is hermetically sealable if the slot through which the fold pass is slightly wider than twice the thickness of the container (the thickness of the container means the accumulative thickness of the two films that form the container). The thickness of the slot has to be optimized so that from one side it will be wide enough so that the folded container may be freely slided through the slot and from the other side, it has to be narrow enough so that water can not pass through the fold. In the same manner, the diameter of the elongated rod has to be adjusted so that the folded container may be freely inserted into the gap between the elongated member and the rod. The two films in the fold that are situated in the gap have to be tightly contiguous in order to establish a good sealing characteristic of the sealer. An example for optimized sizes of a container and a corresponding sealer are: for a container having thickness of approximately 0.9 mm (the thickness of the two films), a sealer having a slot of about 3 mm, a rod of about 3 mm in diameter and an inner passage diameter of about 11.5 mm will adapt to sealingly block the passage of liquid from the liquid receiving cavity through the fold while at the same time the insertion of the fold into the cylinder is easy.

It should be clear that the description of the embodiments and attached Figures set forth in this specification serves only for a better understanding of the invention, without limiting its scope as covered by the following Claims.

It should also be clear that a person in the art, after reading the present specification could make adjustments or amendments to the attached Figures and above described embodiments that would still be covered by the following Claims.

The invention claimed is:

1. A sealable flexible liquid container system comprising:

a flexible liquid container having a cavity for receiving liquids, said cavity formed of two films having the majority of their perimeter fused, and a portion of the perimeter unfused so as to present a lateral opening for filling the container with liquids, and a liquid dispensing outlet;

a rod having a first end and a second end, fixedly attached to the container laterally across the lateral opening of the flexible container so that a portion of the container adjacent the lateral opening can be folded over the rod and substantially overlap an adjacent portion of the container; and a sealer comprising an elongated rigid member having two opposite sides along which a hollow cavity is extended with a longitudinal slot wherein said slot is adapted to accommodate said two films, wherein the sealer is provided with an opening on at least one of the opposite sides with a broadening for inserting an end of the rod into the cavity when the portion of the container is folded over the rod into the hollow passage, the slot being narrower than the diameter of the rod, so that the sealer is only to be slidingly mounted sideways over the rod.

2. The system as claimed in claim 1, wherein the length of said rod is slightly longer than a length defining the lateral opening of the container.

3. The system as claimed in claim 1, wherein an end of the rod is provided with a stopper having a diameter that is larger than a diameter of the cavity of said sealer.

4. The system as claimed in claim 1, wherein said rod is welded to the flexible container.

5. The system as claimed in claim 1, wherein said sealer is made from a rigid polymer.

* * * * *

UNITED STATES PATENT AND TRADEMARK OFFICE

CERTIFICATE OF CORRECTION

PATENT NO. : 7,648,276 B2
APPLICATION NO. : 09/989334
DATED : January 19, 2010
INVENTOR(S) : Yoram Gill It is certified that error appears in the above-identified patent and that said Letters Patent is hereby corrected as shown below:

Title Page, Item (54) and at Column 1, lines 1 and 2, title should read:
SEALING DEVICE FOR FLEXIBLE LIQUID CONTAINER Signed and Sealed this
Thirtieth Day of August, 2011

David J. Kappos

David J. Kappos
*Director of the United States Patent and Trademark Office*